US011384625B2

(12) United States Patent
Roessler

(10) Patent No.: US 11,384,625 B2
(45) Date of Patent: Jul. 12, 2022

(54) DEVICE AND METHOD FOR ANGULARLY ORIENTATING WELLBORE PERFORATING GUNS

(71) Applicant: GEODYNAMICS, INC., Millsap, TX (US)

(72) Inventor: Dennis Roessler, Ft. Worth, TX (US)

(73) Assignee: Geodynamics, Inc., Millsap, TX (US)

( * ) Notice: Subject to any disclaimer, the term of this patent is extended or adjusted under 35 U.S.C. 154(b) by 269 days.

(21) Appl. No.: 16/193,039

(22) Filed: Nov. 16, 2018

(65) Prior Publication Data

US 2019/0153829 A1 May 23, 2019

Related U.S. Application Data

(60) Provisional application No. 62/599,063, filed on Dec. 15, 2017, provisional application No. 62/588,981, filed on Nov. 21, 2017.

(51) Int. Cl.
*E21B 43/118* (2006.01)
*E21B 43/117* (2006.01)
*E21B 47/024* (2006.01)

(52) U.S. Cl.
CPC ..... *E21B 43/118* (2013.01); *E21B 43/117* (2013.01); *E21B 47/024* (2013.01)

(58) Field of Classification Search
CPC ..... E21B 43/118; E21B 43/117; E21B 47/024
See application file for complete search history.

(56) References Cited

U.S. PATENT DOCUMENTS 3,762,473 A * 10/1973 Wolk ..... E21B 43/119 166/241.5
4,220,201 A * 9/1980 Hauk ..... E21B 29/00 166/55.2
4,410,051 A * 10/1983 Daniel ..... E21B 43/119 166/55.1
5,195,588 A * 3/1993 Dave ..... E21B 49/10 166/264
5,353,637 A * 10/1994 Plumb ..... E21B 49/008 166/101
5,360,066 A * 11/1994 Venditto ..... E21B 43/119 166/250.1
5,881,807 A * 3/1999 Bøe ..... E21B 27/02 166/100
6,508,307 B1 * 1/2003 Almaguer ..... C09K 8/68 166/308.1
7,152,466 B2 * 12/2006 Ramakrishnan ..... E21B 47/06 73/152.51
7,690,423 B2 * 4/2010 Del Campo ..... E21B 31/00 166/100
2001/0050172 A1 * 12/2001 Tolman ..... E21B 17/203 166/297

(Continued)

*Primary Examiner* — Blake Michener
*Assistant Examiner* — Neel Girish Patel
(74) *Attorney, Agent, or Firm* — Morgan, Lewis & Bockius LLP

(57) ABSTRACT

A steerable sub for controlling an angular orientation of a well tool in a well, the steerable sub including a housing; a steering element attached to the housing and configured (i) to partially extend out of the housing and (ii) to change an orientation relative to the housing; and an actuation mechanism connected to the steering element and configured to change the orientation of the steering element relative to the housing.

20 Claims, 13 Drawing Sheets

(56) References Cited

U.S. PATENT DOCUMENTS

2002/0007949 A1* 1/2002 Tolman ..... E21B 33/138 166/308.1
2002/0189802 A1* 12/2002 Tolman ..... E21B 43/117 166/55
2003/0188867 A1* 10/2003 Parrott ..... E21B 47/024 166/297
2004/0200083 A1* 10/2004 Yarbro ..... E21B 47/024 33/304
2005/0252688 A1* 11/2005 Head ..... E21B 21/00 175/61
2007/0181303 A1* 8/2007 Billingham ..... E21B 43/116 166/297
2008/0196901 A1* 8/2008 Aguirre ..... E21B 17/1078 166/381
2009/0223659 A1* 9/2009 Hill ..... E21B 23/01 166/55.1
2012/0193143 A1* 8/2012 Hill ..... E21B 43/119 175/4.51
2013/0228372 A1* 9/2013 Linyaev ..... E21B 7/15 175/16
2013/0329522 A1* 12/2013 Skinner ..... E21B 47/0224 367/25
2014/0102801 A1* 4/2014 Hallundæk et al. .. E21B 43/114 175/67
2014/0131045 A1* 5/2014 Loiseau ..... E21B 43/119 166/305.1
2015/0129203 A1* 5/2015 Deutch ..... E21B 43/11 166/250.1
2015/0167416 A1* 6/2015 Ludwig ..... E21B 23/14 166/385
2015/0240626 A1* 8/2015 Ludwig ..... E21B 47/01 166/250.01
2015/0267500 A1* 9/2015 Van Dongen ..... E21B 33/14 277/336
2016/0017704 A1* 1/2016 Camwell ..... E21B 47/09 250/257
2016/0024902 A1* 1/2016 Richter ..... E21B 43/116 166/250.01
2016/0025945 A1* 1/2016 Wanjau ..... E21B 47/07 166/250.1
2016/0290076 A1* 10/2016 Francis ..... E21B 19/22
2016/0312587 A1* 10/2016 Montaron ..... E21B 29/06
2020/0277841 A1* 9/2020 Olliff ..... E21B 44/02

* cited by examiner

DEVICE AND METHOD FOR ANGULARLY ORIENTATING WELLBORE PERFORATING GUNS

BACKGROUND

Technical Field

Embodiments of the subject matter disclosed herein generally relate to downhole tools related to well perforating, and more specifically, to a gun string that includes at least one element having steering means for controlling an angular orientation of a shaped charge of the gun string.

Discussion of the Background

In the oil and gas field, once a well 100 is drilled to a desired depth H relative to the surface 110, as illustrated in FIG. 1, and the casing 102 protecting the wellbore 104 has been installed and cemented in place, it is time to connect the wellbore 104 to the subterranean formation 106 to extract the oil and/or gas. This process of connecting the wellbore to the subterranean formation may include a step of plugging the well with a plug 112, a step of perforating the casing 102 with a perforating gun string 114 such that various channels 116 are formed to connect the subterranean formations to the inside of the casing 102, a step of removing the perforating gun string, and a step of fracturing the various channels 116.

Some of these steps require to lower into the well 100 a wireline 118 or equivalent tool, which is electrically and mechanically connected to the perforating gun string 114, and to activate the gun string and/or a setting tool 120 attached to the perforating gun string. The setting tool 120 is configured to hold the plug 112 prior to plugging the well and then to set the plug. FIG. 1 shows the setting tool 120 disconnected from the plug 112, indicating that the plug has been set inside the casing and the setting tool 120 has been disconnected from the plug 112.

FIG. 1 shows the wireline 118, which includes at least one electrical connector, being connected to a control interface 122, located on the ground 110, above the well 100. An operator of the control interface may send electrical signals to the perforating gun string and/or setting tool for (1) setting the plug 112 and (2) disconnecting the setting tool from the plug. A fluid 124, (e.g., water, water and sand, fracturing fluid, etc.) may be pumped by a pumping system 126, down the well, for moving the perforating gun string to a desired location, e.g., where the casing needs to be fractured.

The above operations may be repeated multiple times for perforating and/or fracturing the casing at multiple locations, corresponding to different stages of the well. These completion operations may require running back and forth the gun string so that each gun is positioned at a desired location. More specifically, after a first gun is fired at its desired position, the remaining guns have to be moved to another position, where a second is going to be fired. Then, the gun string is further moved until the third gun is in position, and so on. However, only positioning each gun to the desired location underground is not enough for an efficient perforation. It is known in the art that certain zones around the casing should not be perforated while other zones need to be perforated. More specifically, FIG. 2 shows a cross-section through a system 200 that includes plural guns 220 (only one is shown) located in a casing 210. Around the casing 210, there are plural zones Z1 to Z5 of the subsurface. FIG. 2 assumes that the gun 220 is positioned at a certain depth inside the casing and shows only one shaped charge 222, that is directed along a direction D (firing direction herein). Assume that the intent of the operator of the system 200 is to perforate the casing to communicate with zone Z1, but not with the other zone. Then, the perforation direction D of the shaped charge 222 is pointing to the wrong zone.

This is a real problem faced by the operator of the well. The existing methods for aligning the firing direction of the guns with the desired zones to be perforated include adding a weight W to the gun carrier or an adjacent sub, as illustrated in FIG. 2, so that the weight would settle at the bottom of the casing (when the gun is located inside a horizontal portion of the casing) and the shaped charges would have their perforation directions angularly oriented as desired. In other words, the shaped charges are oriented relative to the weight, when the gun is manufactured, so that the shaped charges will perforate along the desired direction when the weight is at the lowest position inside the casing.

However, these methods are not very reliable and also do not allow to change an orientation of the gun after the gun has been deployed in the well. Thus, there is a need for a gun string that can adjust its perforation direction as desired for perforating the casing only towards the desired zones and not other zones.

SUMMARY

According to an embodiment, there is a steerable sub (or any other well device) for controlling an angular orientation of a well tool in a well. The steerable sub includes a housing, a steering element attached to the housing and configured (i) to partially extend out of the housing and (ii) to change an orientation relative to the housing, and an actuation mechanism connected to the steering element and configured to change the orientation of the steering element relative to the housing.

According to another embodiment, there is a gun string for perforating a casing in a well. The gun string includes a gun that includes one or more shaped charges, the one or more shaped charges having a firing direction D; and a steerable sub connected to the gun. The steerable sub is configured to rotate relative to a longitudinal axis Y of the casing to align the firing direction D with a desired firing orientation DD. In one application, the sub is a traditional sub and the steerable mechanism is placed on the gun carrier or any other device in the well that moves with the gun string.

According to still another embodiment, there is a method for perforating a casing in a well with a gun string. The method includes a step of lowering the gun string into the well, wherein the gun string includes a first gun, and the first gun includes one or more shaped charges, the one or more shaped charges having a first firing direction D1, a step of steering the gun string with a steerable sub, while lowering, to minimize an angle between the first firing direction D1 and a preset first firing orientation DD1, a step of stopping the gun string (which is optional) when arriving at a first location along the well, and a step of firing the first gun so that the one or more shaped charges fires along the preset first firing direction DD1.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a steerable sub attached to a gun string. However, the embodiments discussed herein are also applicable to a gun string that has a steerable gun or to a steerable sub attached to any other well tool that needs to be positioned in the well with a given angular orientation.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, a steerable sub is provided as being part of a gun string. The steerable sub has means (e.g., a wheel and/or a fin) for controlling an angular position of the sub relative to the gravity. The steerable sub may include one or more of these means. In one application, the steerable sub has an engine and a power source that supplies the engine with power so that the steering means can be controlled. The engine may include an electrical motor, or a solenoid, or a linear motor or any other means for controlling an orientation of the steering means. In another application, the steerable sub includes electronics (e.g., processor, memory, etc.) and one or more sensors for detecting the orientation of the gun relative to the gravity and also for controlling the steering means so that a firing direction of the gun (the shaped charges) can be aligned with the desired direction.

Figure 1:
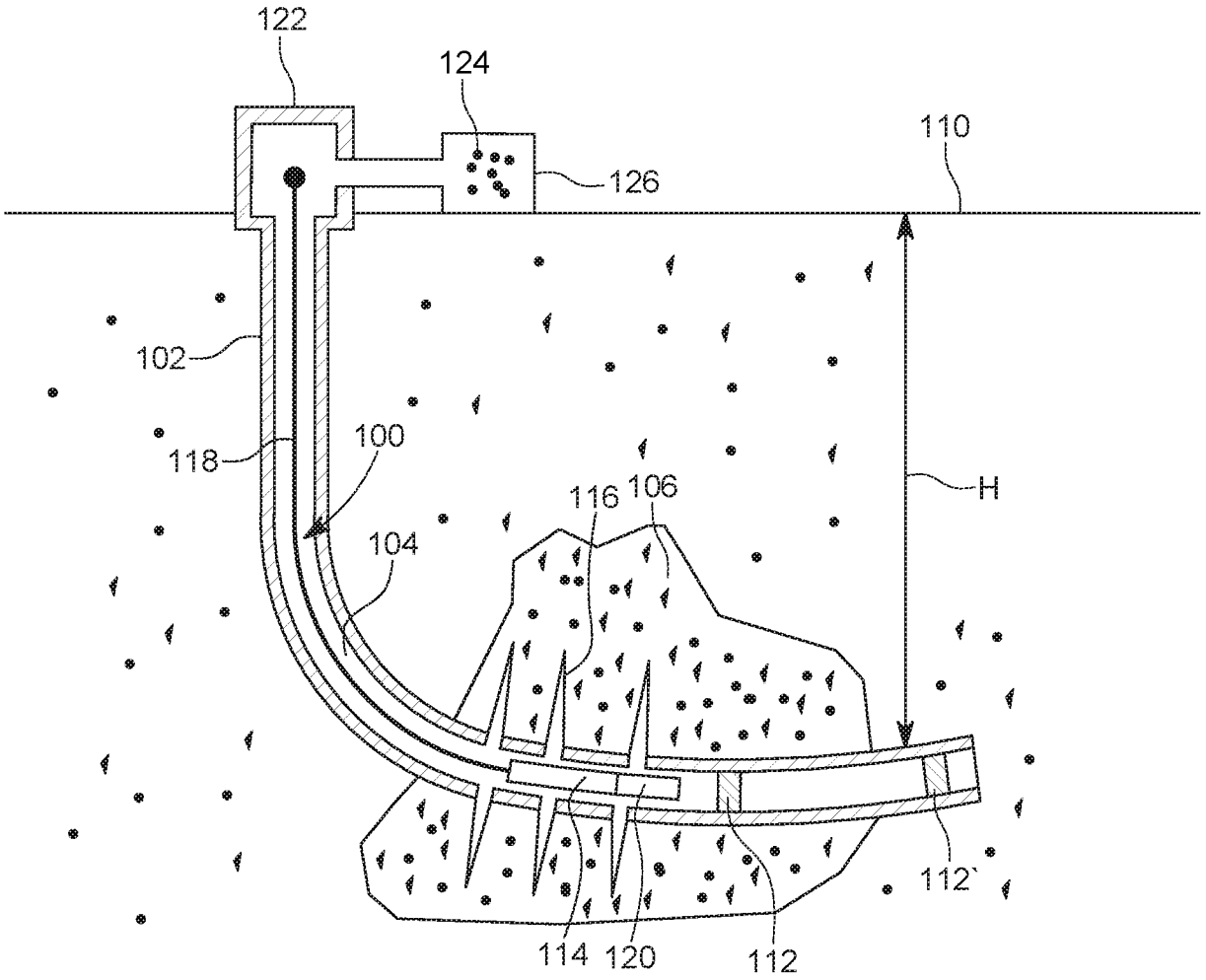
FIG. 1 (BACKGROUND ART)
FIG. 1 illustrates a well and associated equipment for well completion operations.
Figure 2:
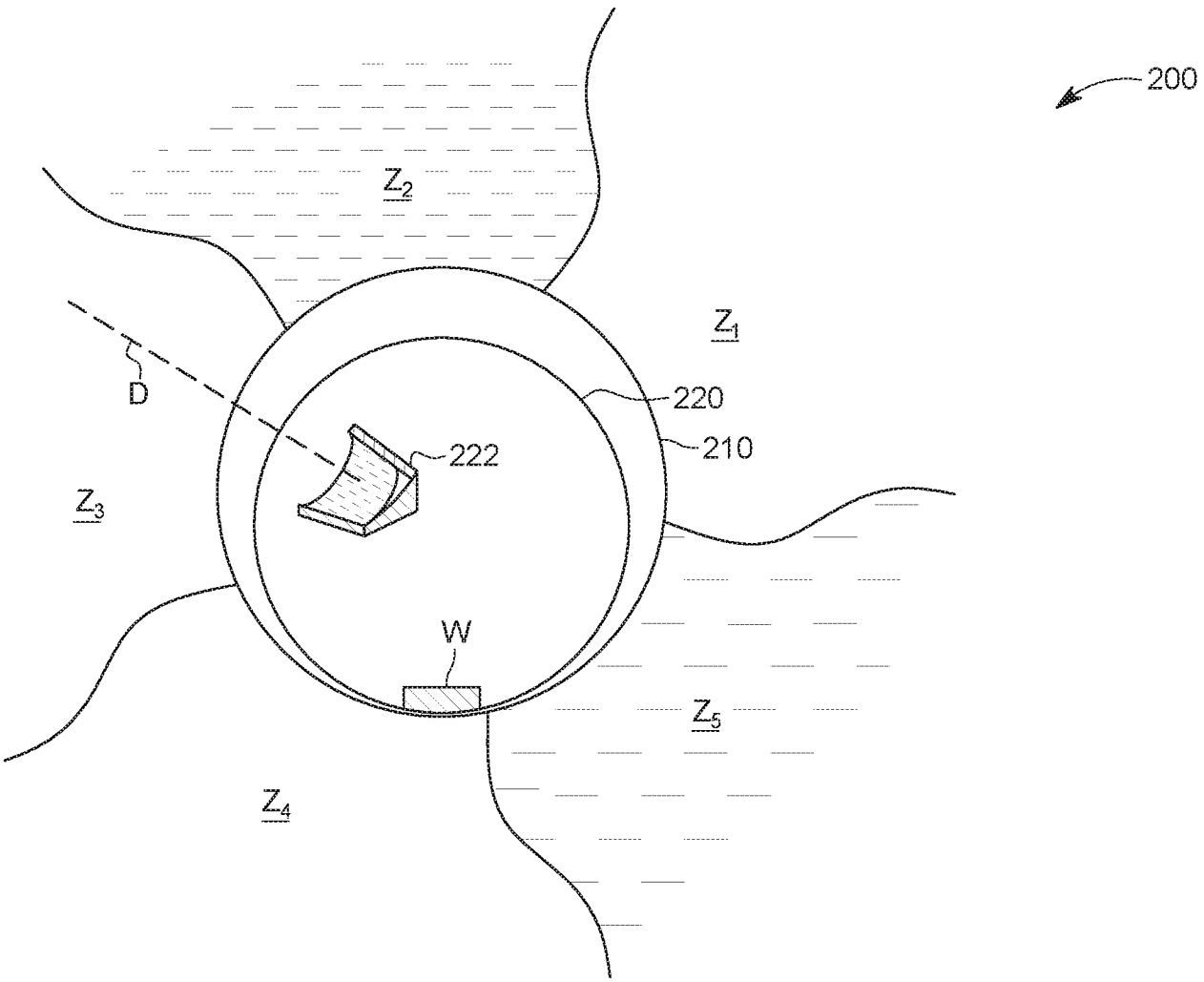
FIG. 2 (BACKGROUND ART)
FIG. 2 illustrates the orientation of a shaped charge relative to plural zones existing around the casing.
Figure 3:
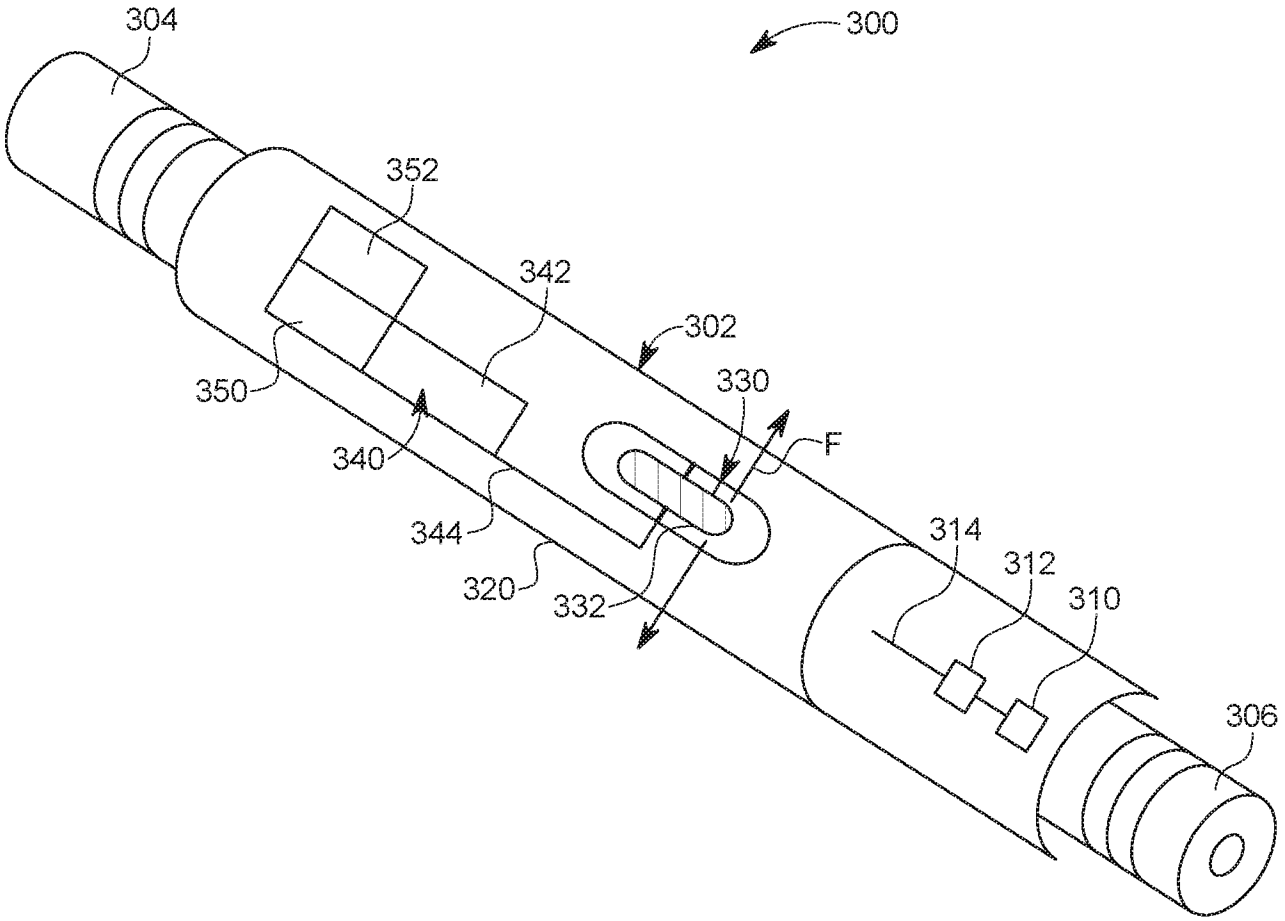
FIG. 3 illustrates a steerable sub.

FIG. 3 shows a steerable sub 300 that has a housing 302, the housing having an upper end 304 and a lower end 306 configured to be attached to corresponding guns (not shown) or other well elements. The housing 302 houses the typical components of a sub, e.g., detonator 310, switch 312, and communication line 314. However, in addition to these elements, the steerable sub 300 also includes a steerable section 320 that holds a steering element 330, an actuation mechanism 340, a power source 350, and a controller 352. The power source 350 supplies power to the actuation mechanism 340 and the controller 352. In one application, the power source 350 includes one or more batteries. The steering mechanism 330 may include, for example, a wheel 332. The actuation mechanism 340 may include, for example, an engine 342 and a rod 344, which is attached to the steering element 330. The engine 342 may be controlled by the controller 352 for actuating the rod 344, which turns the wheel 332 in one of two opposite directions F. In this way, the controller 352 is capable to control the direction of the wheel 332, and thus, implicitly the orientation of the housing 302 while moving through the casing. While the communication line 314 is electrically connected to a main controller operated by the operator at the surface, the controller 352 is configured to operate independent of the communication line 314. In other words, controller 352 may be electrically independent of the switch 312 and line 314.

Figure 4B:
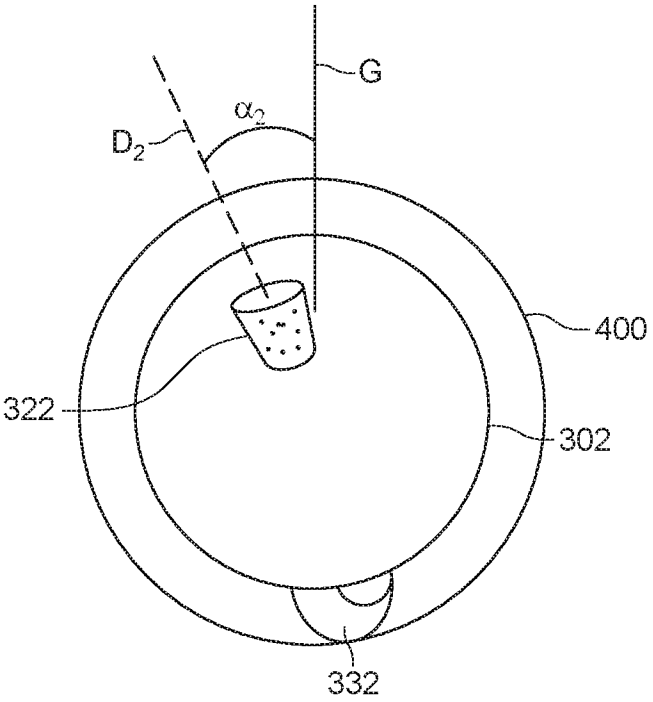
FIGS. 4A and 4B illustrate various orientations of a shaped charge when inside a well.
Figure 4A:
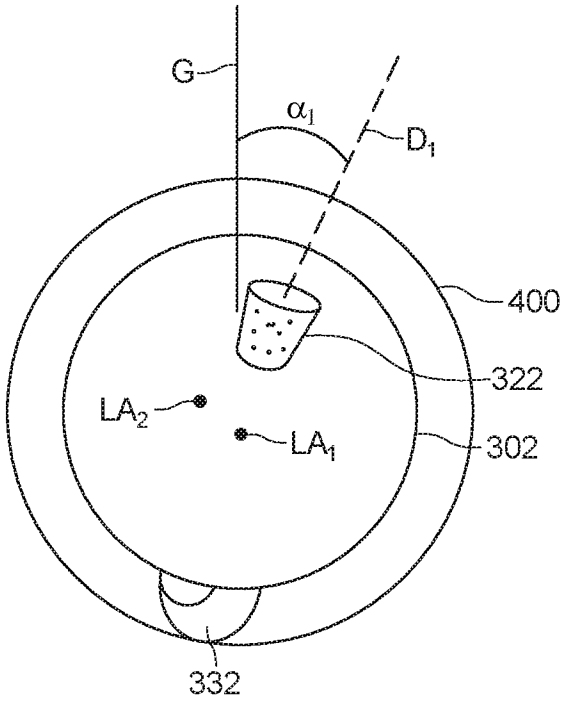

Regarding the angular orientation of the housing, FIG. 4A shows a case in which the wheel 332 is turned in one direction so that a shaped charge 322 starts to rotate its firing direction $D_1$ away from the gravity G (note that axis G points opposite to the actual direction of the gravity), so that the two lines $D_1$ and G form a first angle $\alpha_1$. FIG. 4B shows the case in which the wheel 332 is turned in the opposite direction so that the shaped charge 322 starts to rotate its firing direction $D_2$ away from the gravity G, but in the opposite direction than the case shown in FIG. 4A. The two lines $D_2$ and G now form a second angle $\alpha_2$. Depending on how much the wheel 332 is turned and for how long, the deviation angle $\alpha$, defined as the angle made by the gravity G and the firing direction D, can be controlled to achieve any orientation of the shaped charge 322.

Figure 4D:
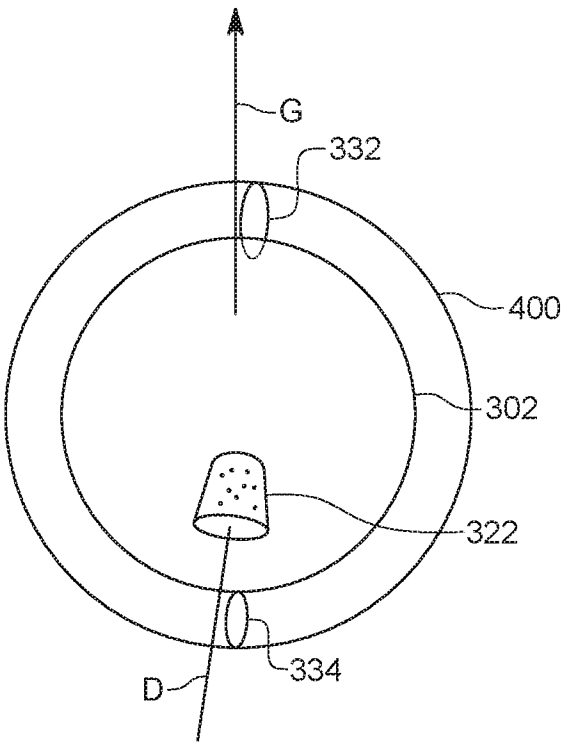
FIGS. 4C and 4D illustrate how the orientations of the shaped charges can be controlled with a steerable sub.
Figure 4C:
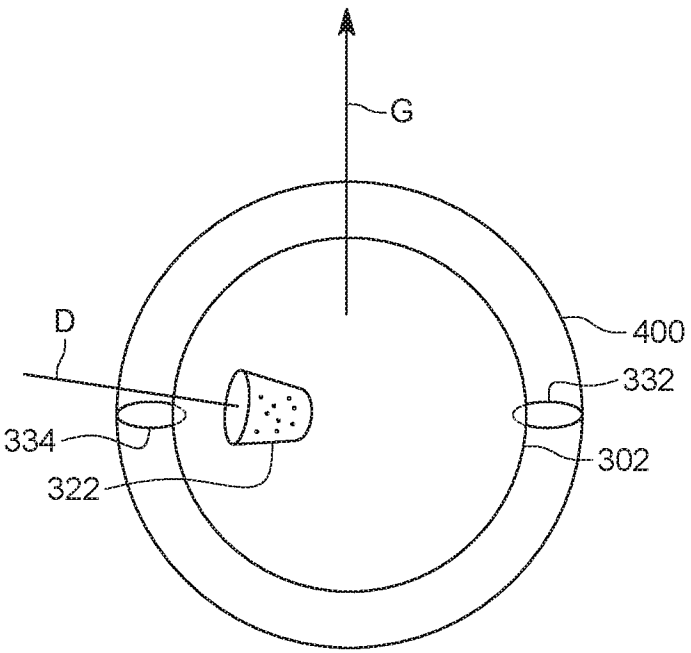

For example, FIG. 4C shows that the steering wheel 332 has been turned so that the firing direction D of the shaped charge 322 forms an angle of about 90 degrees with the gravity G while FIG. 4D shows that the firing direction D of the shaped charge 332 forms an angle of about 180 degrees with the gravity G. FIGS. 4C and 4D also show a second wheel 334 that is disposed opposite to the steering wheel 332. The second wheel 334 may be or not a steering wheel. The purpose for the second wheel 334 is to offer a counterforce on the casing 302 so that enough friction is exerted between the steering wheel 332 and the casing 302. More than two wheels 332 may 334 may be used for a given sub.

Figure 4E:
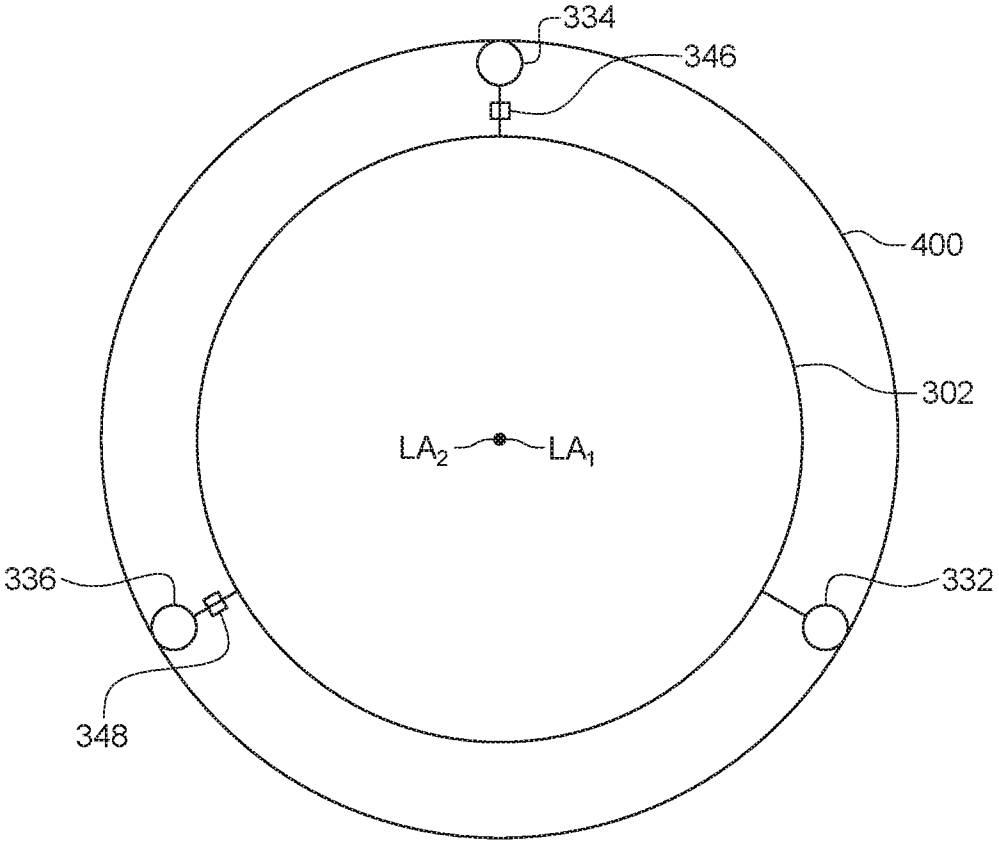
FIG. 4E shows a steerable sub having plural wheels.

In one embodiment, as illustrated in FIG. 4E, three wheels 332, 334, and 336 are distributed around the sub 300 and one or more of these wheels are biased against the inner wall of the casing 400 so that steering of the wheel 332 rotates the housing 302 inside the casing. Note that while FIG. 3 shows the steering wheel 332 partially located inside the housing 302, it is also possible that the steering wheel is located completely outside the housing, as illustrated in FIG. 4E. The biasing against the one or more steerable wheels may be achieved with a biasing mechanism 346 (e.g., a spring) or with a pneumatic system 348 (e.g., an internal piston placed in a pressurized chamber). Other means may be used to bias one or more of the wheels 332, 334, and 336 against the casing 400.

Figure 5:
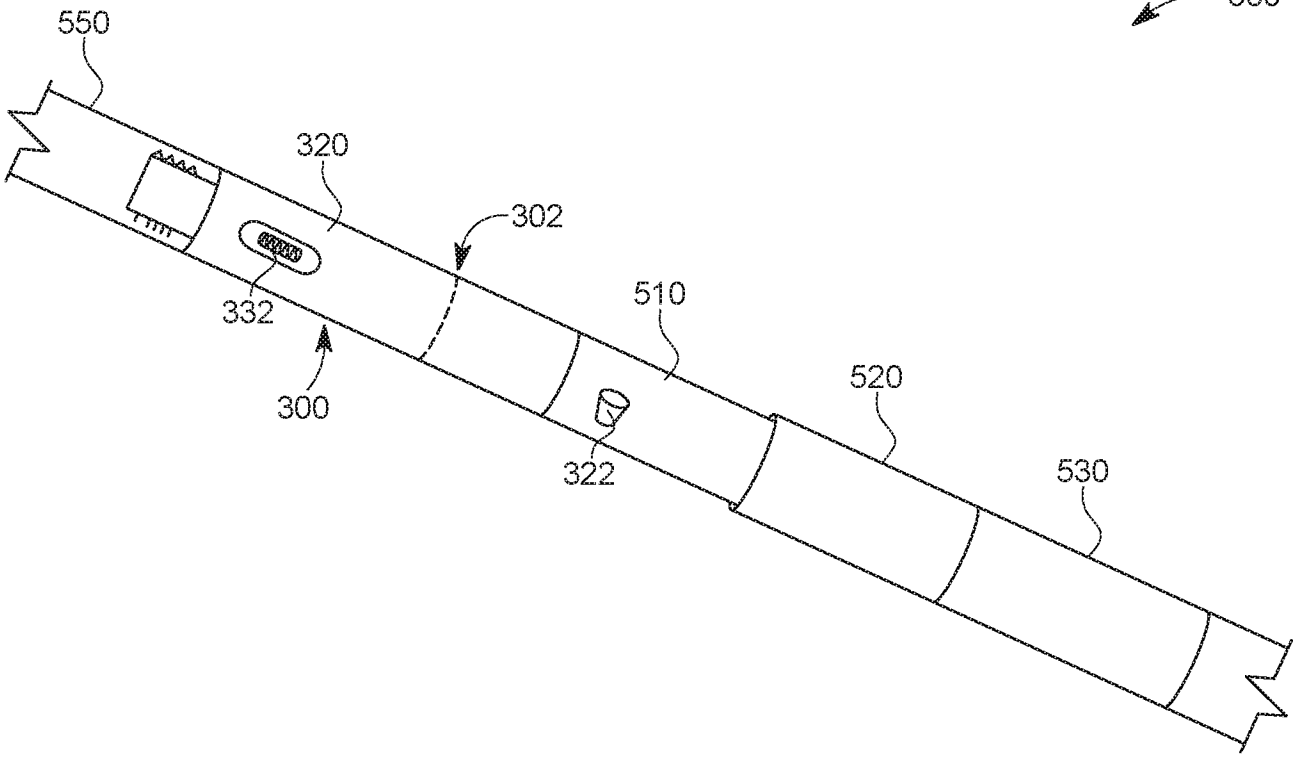
FIG. 5 shows a gun string having a steerable sub attached to plural guns.

While FIGS. 4A to 4E show the steering wheel 332 directly attached to the steering sub 300, one would understand that the same mechanism may be deployed directly on a gun carrier. FIGS. 4A to 4D appear to show that the shaped charge 322 is located in the housing 302 of the steering sub 300. This is not the case as the shaped charge 322 is placed in a corresponding gun 510, and not in the steerable sub 300, as illustrated in FIG. 5. The shaped charge 322 has been shown in FIGS. 4A to 4D only to provide an indication for the firing direction relative to the gravity.

Figure 6:
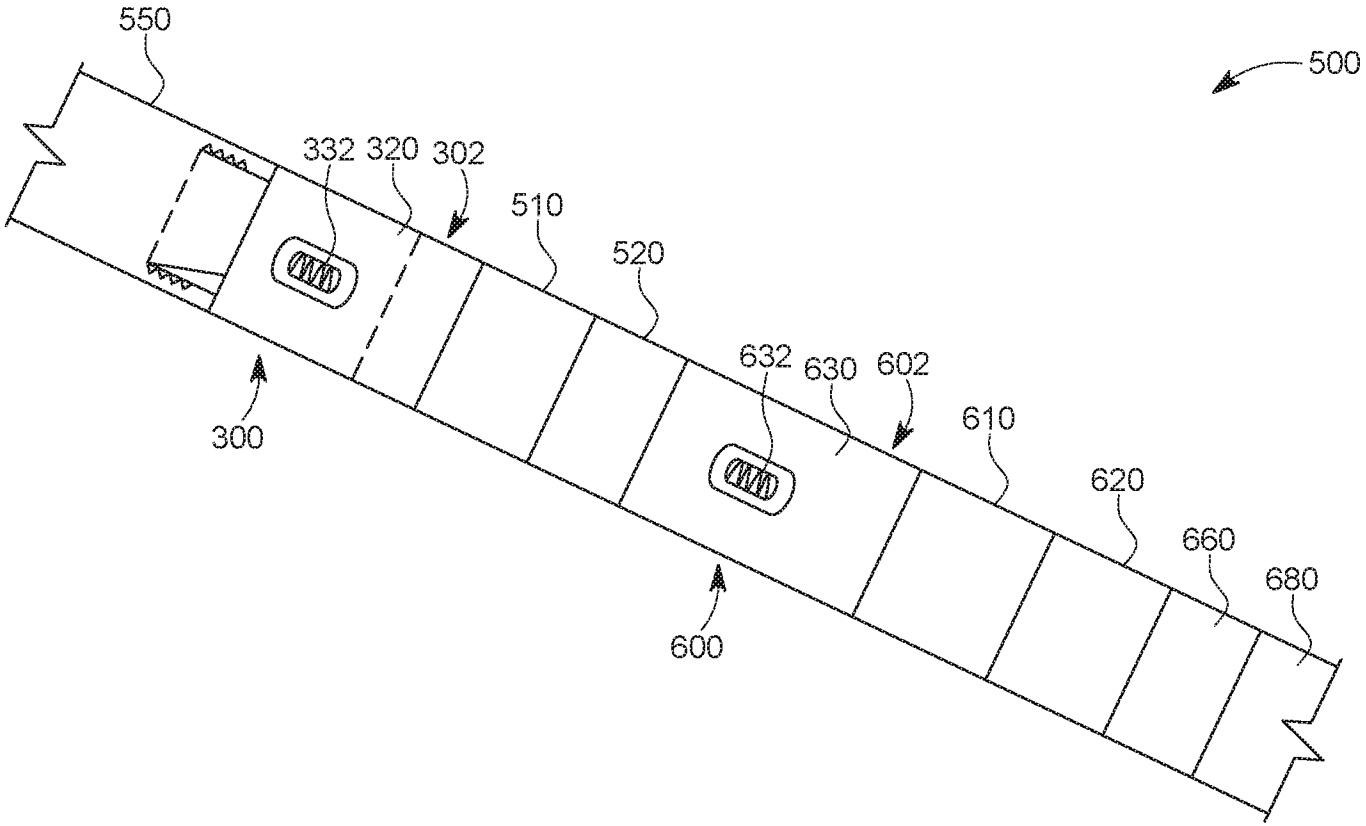
FIG. 6 shows a gun string having two steerable subs.

FIG. 5 shows a gun string 500 having a single steerable sub 300, which is attached to plural guns 510, 520, 530. As these guns are attached in a fixed manner to each other and also relative to the steerable sub 300, any rotation of the steerable sub 300 relative to the casing (not shown in FIG. 5) automatically translates into a corresponding rotation of the guns 510, 520, 530, etc. FIG. 5 also shows that the steerable sub 300 is attached to a wellbore tool 550. The wellbore tool 550 may be, in one embodiment, a wireline, slickline, coiled tubing, or drill pipe. In another embodiment, as illustrated in FIG. 6, another steerable sub 600 may be added to the gun string 500. For this embodiment, the second steerable sub 600 may have its own steerable wheel 632 as part of the steering element 630, and the steerable wheel is housed by the housing 602. The second steerable sub 600 may be sandwiched between a first plurality of guns 510, 520 and a second plurality of guns 610, 620. The number of guns distributed between the two steerable subs 300 and 600 may vary from one to many. All these guns and subs form the gun string 500.

In one application, it is possible to have plural steerable subs and plural sets of guns attached to each other, in any order. It is also possible to have non-steerable subs 660, attached between plural guns 620 and 680. Any combination of steerable subs, non-steerable subs and guns is possible to be selected to form the gun string 500, as long as there is at least one steerable sub to control the angular orientation of the firing direction of the shaped charges of the plurality of the guns of the gun string 500. As also discussed above, it is possible that the steerable sub has a single steerable wheel or more than one steerable wheels. If plural steerable wheels are used, they may be distributed along the external circumference of the housing of the steerable sub, as illustrated in FIG. 4E. In one embodiment, it is possible that the steerable sub has a single steerable wheel and one or more non-steerable wheels (e.g., casters) as illustrated in FIGS. 4C and 4D so that the steerable wheel is biased against the casing and the resultant friction force is used to steer the gun string. One or more steerable subs may be used in any given gun string. The steerable gun(s) may be placed anywhere along the length of the gun string 500.

If only a wheel is used for a given steerable sub (as illustrated in FIGS. 4A and 4B), the gun string is decentralized, i.e., its longitudinal axis LA1 is not coincident with a longitudinal axis LA2 of the casing as illustrated in FIG. 4A. However, if more wheels are used, as illustrated in FIG. 4E, the longitudinal axis LA1 of the gun string is substantially coincident with the longitudinal axis LA2 of the casing. A steerable wheel may be biased against the casing not only because of the presence of other wheels that press the steerable sub against the casing, but also because of a biasing mechanism (see, for example, elements 346 and 348 in FIG. 4E) that pushes away from the housing the steerable wheel.

Figure 7:
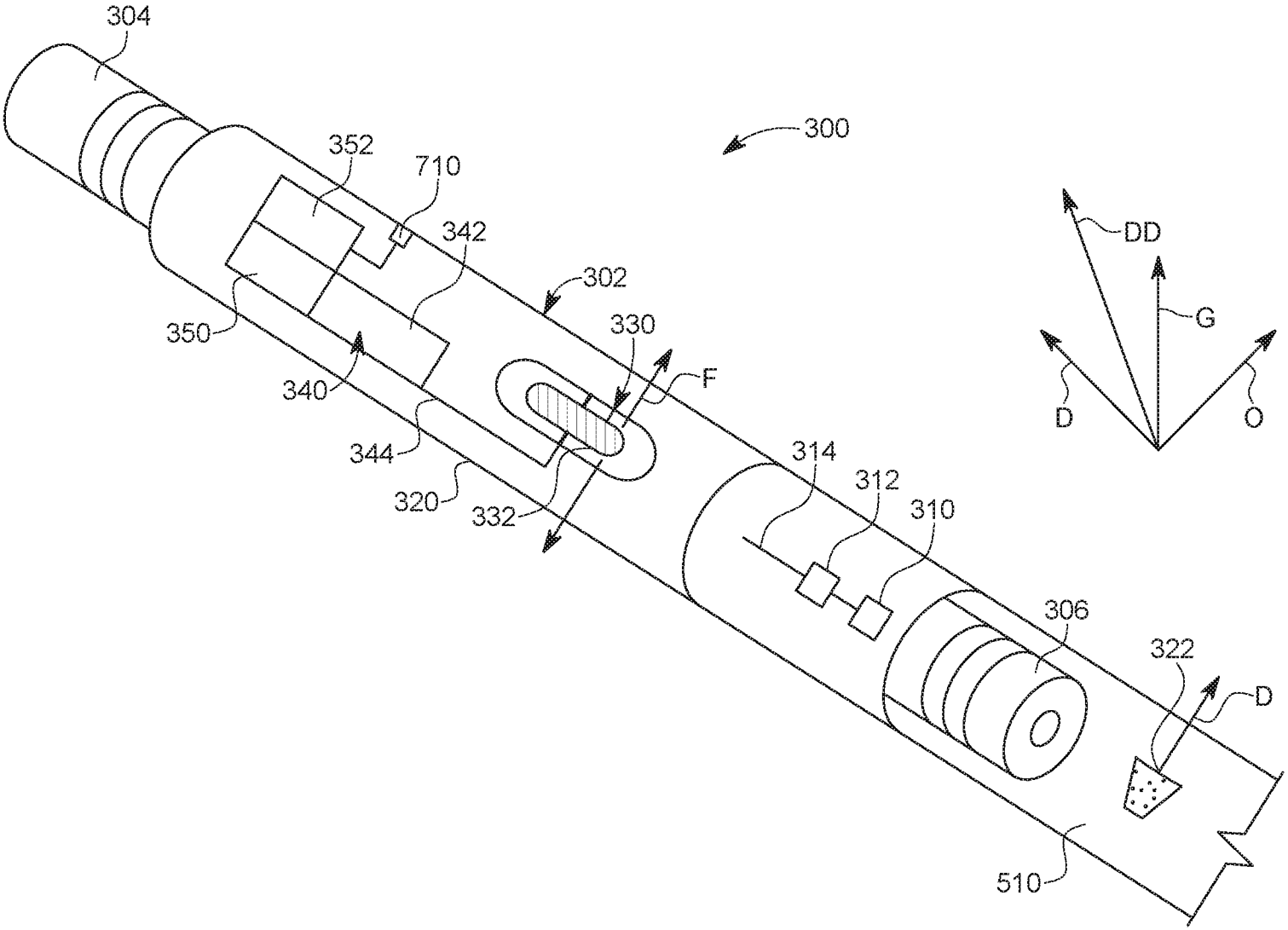
FIG. 7 illustrates the various components associated with a steering element for steering the steerable sub.

Controlling the angular orientation of the guns is achieved as now discussed. FIG. 7 shows the steerable sub 300 having, besides the controller 352, one or more sensors 710, electrically connected to the controller. Sensor 710 can include, one or more of an accelerometer, inclinometer, and/or magnetometer. Based on readings from the sensor 710, the controller 352 can calculate an absolute orientation O of the housing 302 relative to the gravity G. This absolute orientation O, which is schematically illustrated in FIG. 7, makes a certain angle with the gravity G. The controller 352 may also calculate the orientation of the gravity G, by using, for example, the magnetometer or a gravity sensor. The firing direction D of the shaped charge(s) 322 of a given gun 510 is known relative to housing from when the gun string has been assembled and this information is stored in a memory associated with the controller 352.

Thus, when the gun string is deployed into the well, the controller 352 is configured to determine the orientation of the gravity G, the absolute orientation O of the gun string, and the actual orientation of the firing direction D. Note that in one embodiment, the absolute orientation O of the gun string may coincide with the firing direction D, otherwise, the angle between the absolute orientation O and the firing direction D is known. In another embodiment, the controller 352 may be configured to determine only the relative angle between the gravity G and the orientation O and/or the gravity G and the firing direction D. With this data, the controller 352 calculates in which direction to rotate the steering wheel 332, and instructs the actuation mechanism 340 to move the rod 344 to steer the wheel 332 to align the firing direction D with a desired firing direction DD, i.e., minimize the angle between D and DD. The desired firing direction DD is inputted to the controller 352 before the gun string is lowered into the well, or just before the first gun is fired, when there is still possible to communicate with the controller 352 from the surface. Note that after the first gun is fired, wired communication with the controller 352 is likely lost.

For these reasons, the controller 352 is configured to operate in an autonomous way. This means that the controller has its own power source 350, calculates the orientation of the firing direction D based on information acquired from its own sensors 710, and determines the steering amount for the steering wheel based on the known desired firing direction DD. No other input is necessary from the operator of the well for adjusting (steering) the gun string to adjust its angular orientation (radial direction) within the well. Thus, the controller 352 is capable to adjust the steerable wheel 332 in two modes: (1) continuously, as the gun string is lowered into the well, or (2) at selected times, as the controller determines that the gun string is moving and is below than a certain depth into the well. The adjustment of the steering wheel, and implicitly of the firing direction D, is performed by the controller 352 in an autonomous way, according to a sequence recorded in the memory of the controller before the firing.

Figure 8:
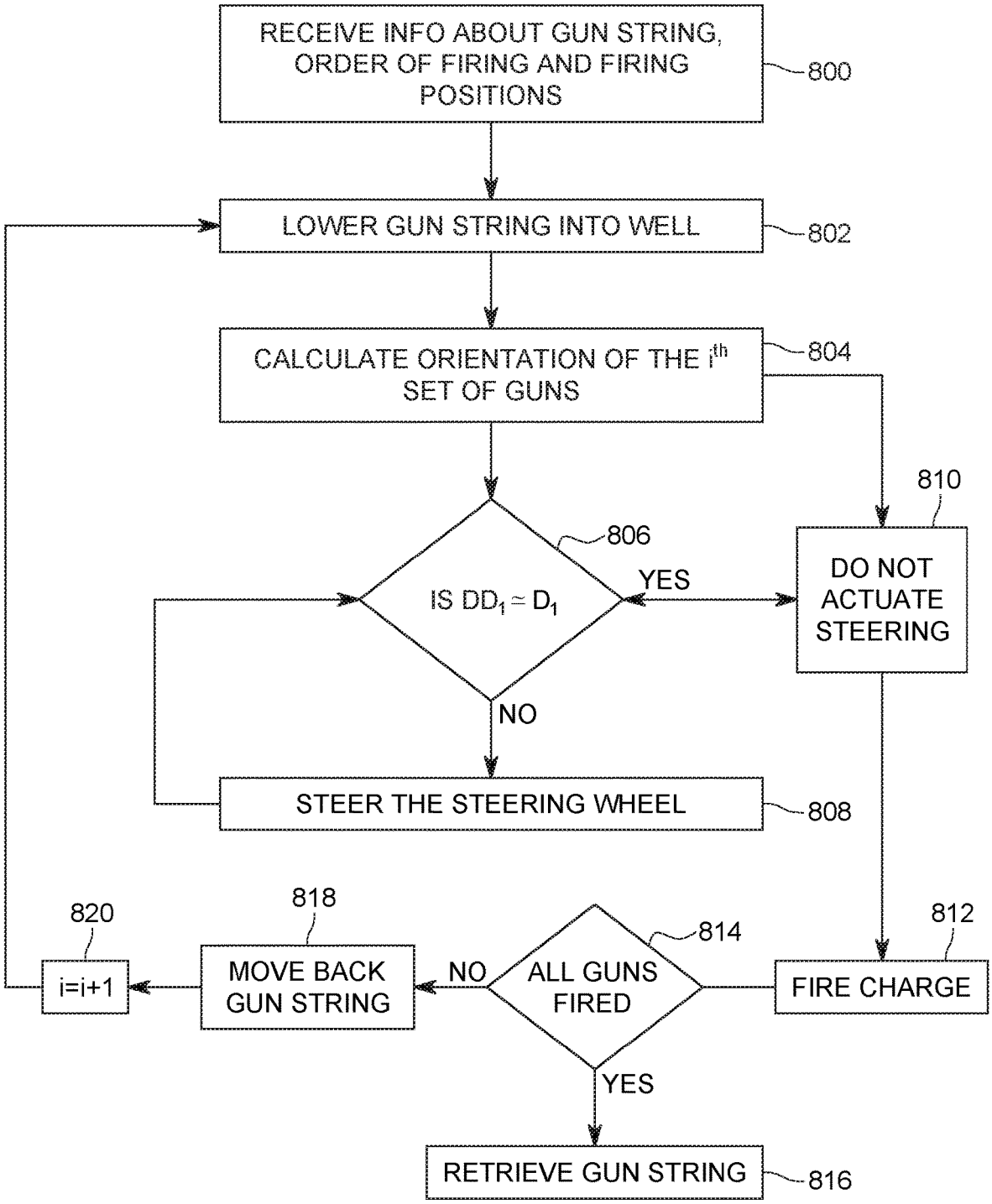
FIG. 8 is a flowchart illustrating a method for steering a gun string to achieve a minimum angle between a firing direction of a shaped charge and a predetermined firing orientation.

More specifically, a method of firing three different sets of guns is now discussed with regard to FIG. 8. The method starts with step 800, in which the number (3 in this case) of sets of guns and their firing orientations (D1 to D3) is input to the controller. Note that the firing orientations D1 to D3 may be the same or different from each other. The first set should fire the shaped charges along a desired firing direction DD1, the second set along a desired firing direction DD2, and the third set along a desired firing direction DD3. This information is also provided to the controller in step 800 or a subsequent step. Further, suppose that the first set of guns should fire first at a first location, the second set of guns should fire second at a second location, and the third set of guns should fire third at a third location along the well. All this information is also transferred to the controller.

The steerable sub is then lowered in step 802 into the well, together with the three sets of guns. Note that more or less sets of guns may be used and the case discussed herein uses three sets of guns for simplicity. As the gun string (the gun string includes all three sets of guns) is moving toward its first location, where the first set of guns needs to be fired, the controller calculates in step 804, based on measurements received from the sensor 710, the angle between the gravity (or the first desired firing position DD1) and the firing direction D1 of the first set of guns. Note that the controller calculates in this step the angle between the gravity (or the ith desired firing position DDi) and the ith firing direction Di of the ith set of guns, where "i" is originally assigned value 1 and then changed incrementally later. If this angle is larger than a given threshold, for example, 1 to 2 degrees (but other numbers may also be used), the controller 352 decides in step 806 that it needs to adjust the firing direction D1 of the first set of guns and thus, it instructs in step 808 the steering wheel to change its orientation. This process is repeated then until the firing direction D1 is within the threshold, to the first desired firing position DD1. When the two positions are close enough, then the process advances to step 810, where the steering wheel is maintained parallel to the longitudinal axis of the casing, so that the firing position D1 does not change. However, during the step 810, the controller 352 continues to calculate the orientation of the first set of guns and, if it determines that the first firing direction D1 has deviated from the first desired firing position DD1, it can force the process to return to step 806.

In step 812, when first set of guns has arrived at its desired first position, the operator of the gun string fires the shaped charges of the first set of guns. Note that because the firing directions D1 to D3 of the three sets of guns are different, for this firing step only the first firing direction D1 of the first set of guns is aligned with the first desired firing orientation DD1. After the first set of guns has been fired, the controller checks in step 814 if all the sets of guns have been fired. If the result of this step is affirmative, the operator retrieves in step 816 the gun string from the well as all the guns have been fired. However, if the result is negative, the process continues to step 818, in which the gun string is moved back from the first position. In step 820, the value of ith set of guns is increased by one to address the firing of the next set of guns, i.e., the second set of guns according to this description. Then the process returns to step 802, in which the gun string is again lowered and the controller calculates now the angle between the gravity (or the second desired firing position DD2) and the second firing direction $D_2$ of the second set of guns. The process steers the entire gun string so that the second desired firing position $DD_2$ is aligned with the second firing direction $D_2$ and then fires the second set of guns. The process then continues until all the sets of guns are fired. Note that after firing each set of guns, the gun string is moved back and forth to give the controller the opportunity to adjust the firing direction of the next set of guns for their firing. If plural steerable subs are provided on the same gun string, the controller 352 may control all the steering wheels in unison, as discussed above, to achieve the same angular orientation for the entire gun string. With the method discussed above, it is possible to allow multiple guns to shoot in the same zone, an each gun to have a different firing direction, which will greatly increase the effective density of the zone.

Figure 9:
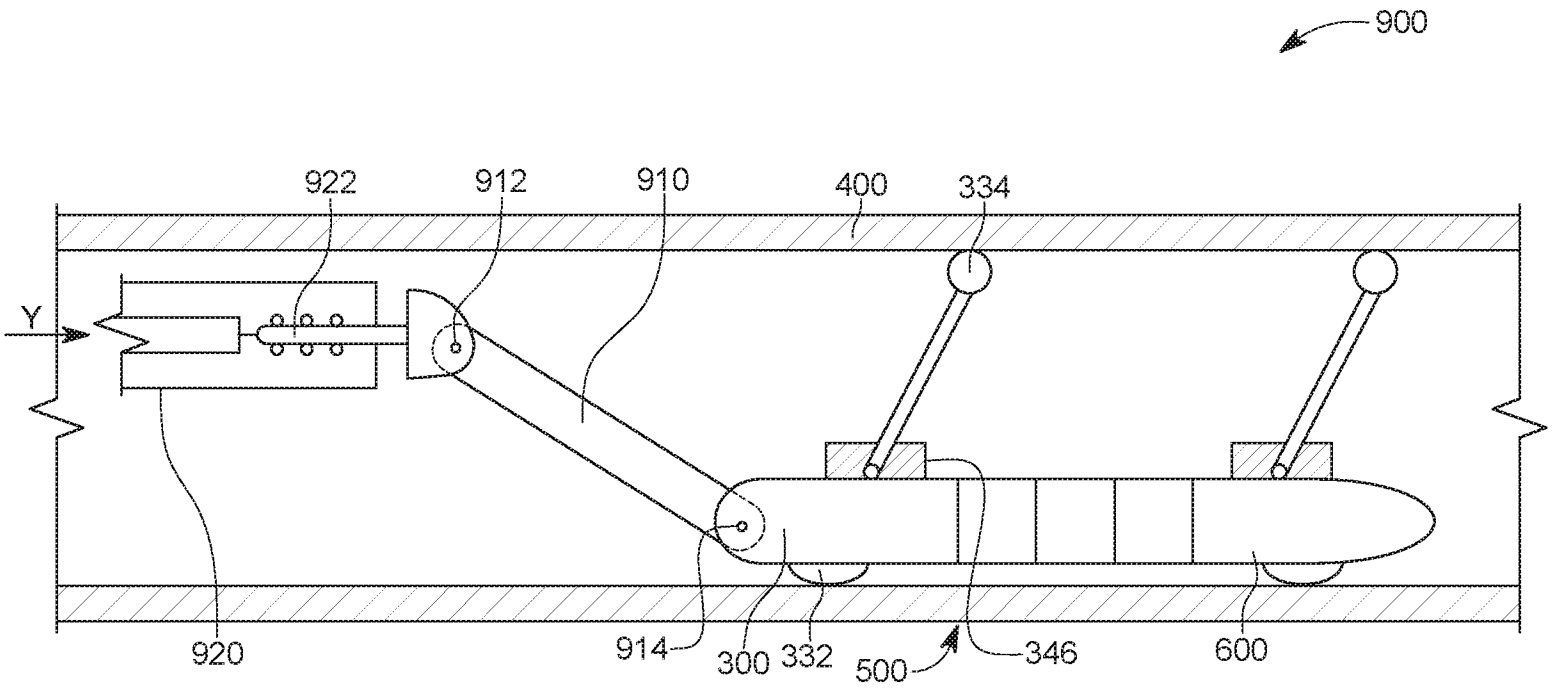
FIG. 9 illustrates a steerable sub attached with a rotatable arm to a drill pipe.

According to another embodiment, it is possible to attach a steerable sub to a drill pipe or coiled tubing (called "line" herein). These lines are know to be very stiff, which makes harder, if not impossible, for the steering wheel to turn (twist) the drill pipe or coiled tubing. Thus, for any stiff line that holds the gun string, in this embodiment, as illustrated in FIG. 9, the steerable sub 300 is attached to a de-centralizer arm 910, which is attached to the line 920. The de-centralizer arm 910 allows the gun string 500 to freely rotate relative to the line 920 as a swivel 922 is located inside the line and allows free rotation of the arm relative to its longitudinal axis Y. In addition, the de-centralizer arm 910 has a first hinged connection 912 with the line 920 and a second hinged connection 914 with the gun string 500, so that the gun string can move almost freely along a radial direction of the casing 400. In other words, the first and second hinged connections 912 and 914 allow the arm 910 to freely pivot relative to the line 920 and/or gun string 500.

In this embodiment, to ensure good friction between the steerable wheel 332 (or steerable fin) and the casing, at least one biasing wheel (a caster wheel in this case) 334 is placed on the steerable sub 300 to push the steering wheel against the casing. FIG. 9 shows two steerable wheels and two biasing wheels. However, one of each wheels may suffice for this embodiment. Also, more than two of each of these wheels may be used. FIG. 9 also shows a biasing mechanism 346 that applies the biasing force on the biasing wheel 334. The biasing mechanism may be a spring, hydraulic mechanism, or other known force applying mechanisms. For this embodiment, the line 920 does not rotate when the gun string 500 rotates relative to the longitudinal axis of the casing. As in the previous embodiments, the steering wheel (s) is capable to rotate the gun string with any desirable angle, for example, $2n\pi+\alpha$, where n can be any positive whole number, including zero, and a is any angle smaller than $2\pi$.

Figure 10:
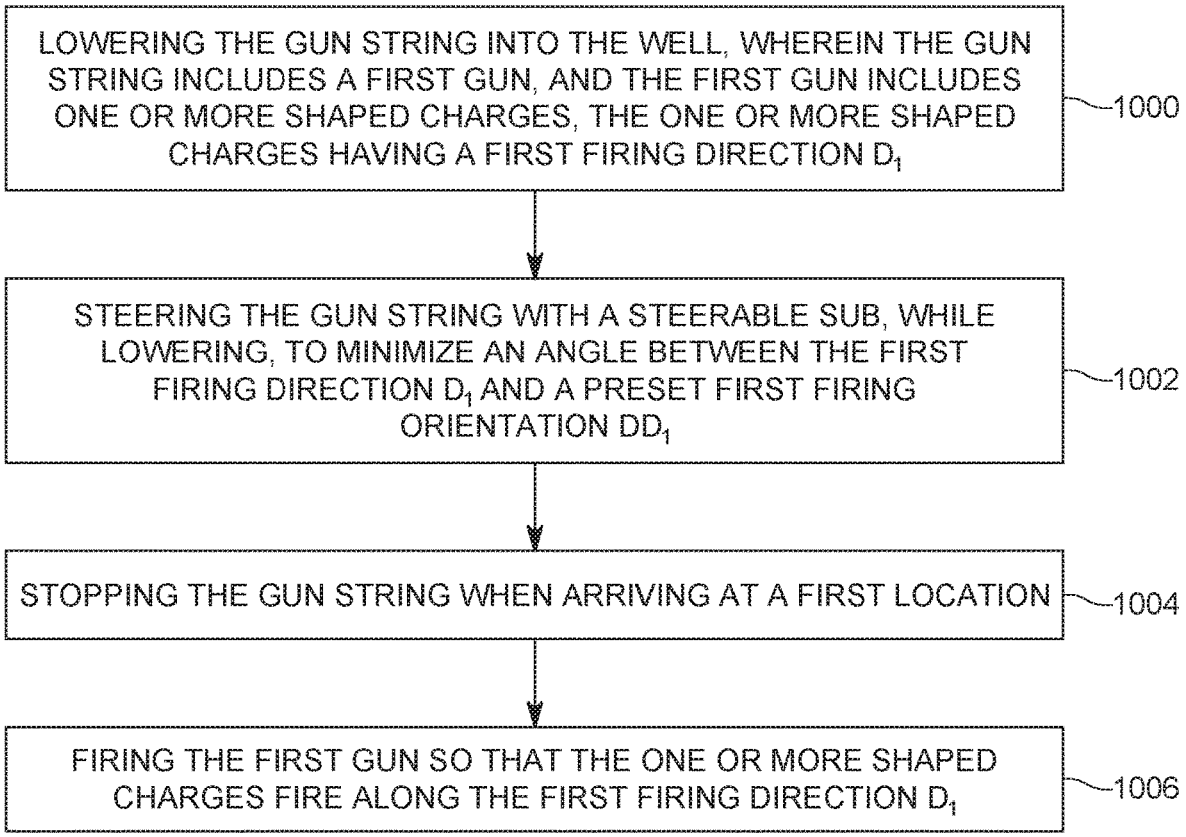
FIG. 10 is a flowchart of a method for steering a gun string inside a well with a steerable sub.

A method for deploying a gun string and controlling its orientation relative to a desired orientation position is now discussed with regard to FIG. 10. The method includes a step 1000 of lowering a gun string 500 into the well. The gun string includes a first gun 510, and the first gun 510 includes one or more shaped charges 322, the one or more shaped charges 322 having a first firing direction D1. The method also includes a step 1002 of steering the gun string 500 with a steerable sub 300, while lowering, to minimize an angle between the first firing direction D1 and a preset first firing orientation DD1, a step 1004 of stopping the gun string 600 when arriving at a first location, and a step 1006 of firing the first gun 510 so that the one or more shaped charges fire along the first firing direction D1.

The method may further include a step of steering the steerable sub 300 while moving the gun string to minimize an angle between a second firing direction D2 of the second gun and a preset second firing orientation DD2, a step of stopping the gun string 500 when arriving at a second location in the well, and a step of firing the second gun so that one or more shaped charges fires along the second firing direction D2. In one application, the step of stopping is skipped, so that the gun string is fired as soon as it arrives at its desired location under ground. The method may also include a step of independently calculating with a processor the angle between the first firing direction D1 and the preset first firing orientation DD1 based on readings from one or more sensors housed within the steerable sub. In one application, the processor adjusts a steering element of the steerable sub based on the calculated angle. The steerable sub twists a wellbore tool that is directly attached to the steerable sub.

Figure 11:
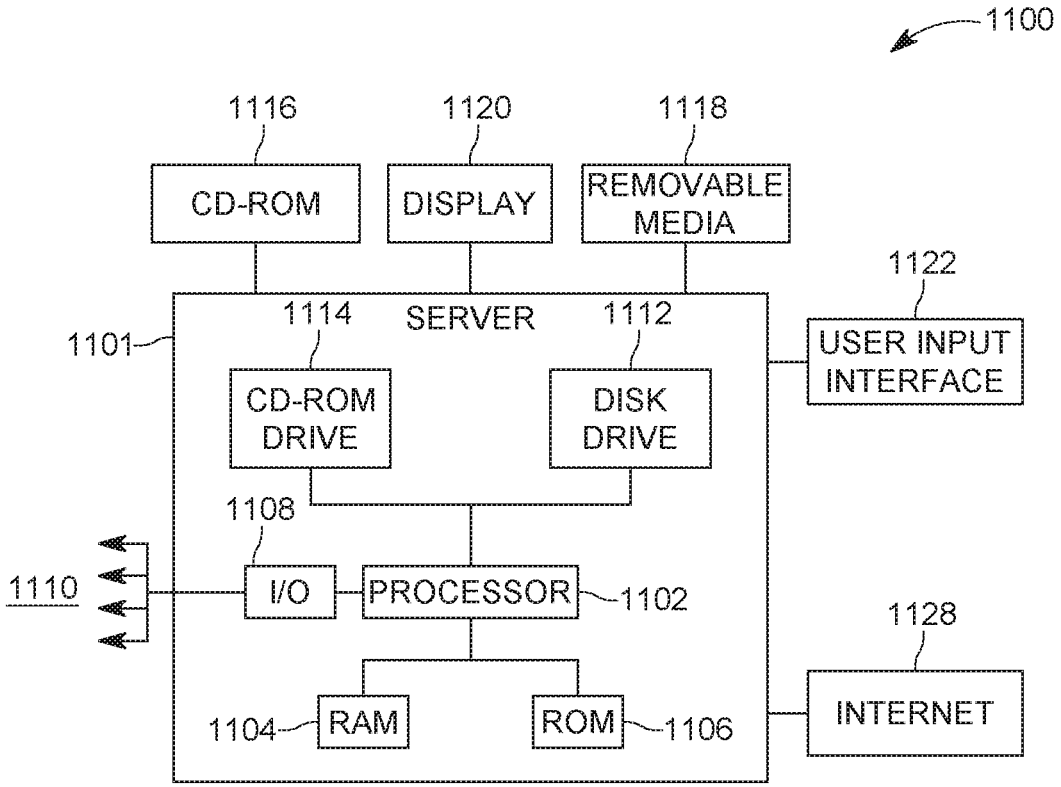
FIG. 11 illustrates a structure of a controller that drives the steerable sub.

The controller 352 can be implemented, for example, as a computing device 1100 as illustrated in FIG. 11. Computing device 1100 may include a server 1101. Such a server

1101 may include a central processor (CPU) 1102 coupled to a random access memory (RAM) 1104 and to a read-only memory (ROM) 1106. ROM 1106 may also be other types of storage media to store programs, such as programmable ROM (PROM), erasable PROM (EPROM), etc. Processor 1102 may communicate with other internal and external components through input/output (I/O) circuitry 1108 and bussing 1110 to provide control signals and the like. Processor 1102 carries out a variety of functions as are known in the art, as dictated by software and/or firmware instructions.

Server 1101 may also include one or more data storage devices, including hard drives 1112, CD-ROM drives 1114 and other hardware capable of reading and/or storing information, such as DVD, etc. In one embodiment, software for carrying out the above-discussed steps may be stored and distributed on a CD-ROM or DVD 1116, a USB storage device 1118 or other form of media capable of portably storing information. These storage media may be inserted into, and read by, devices such as CD-ROM drive 1114, disk drive 1112, etc. Server 1101 may be coupled to a display 1120, which may be any type of known display or presentation screen, such as LCD, plasma display, cathode ray tube (CRT), etc. A user input interface 1122 is provided, including one or more user interface mechanisms such as a mouse, keyboard, microphone, touchpad, touch screen, voice-recognition system, etc.

The server may be part of a larger network configuration as in a global area network (GAN) such as the Internet 1128, which allows ultimate connection to various landline and/or mobile computing devices.

The disclosed embodiments provide methods and systems for controlling an angular orientation of a gun string while in a well so that one or more shaped charges are fired along a desired direction. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A steerable sub for controlling an angular orientation of a well tool in a well, the steerable sub comprising:

a housing extending along a longitudinal axis;

a steering element attached to the housing and extending into a plane, the steering element being configured (i) to partially extend out of the housing and to move along the longitudinal axis while contacting the well and (ii) to turn in either one of two opposite directions, which are perpendicular to the longitudinal axis, which results in tilting the plane of the steering element to make a non-zero angle with the longitudinal axis; and an actuation mechanism connected to the steering element and configured to change the tilt of the steering element relative to the longitudinal axis by turning the steering element while contacting the well.

2. The steerable sub of claim 1, further comprising:

a controller located within the housing and configured to control the actuation mechanism; and a power source that powers the controller and the actuation mechanism.

3. The steerable sub of claim 2, wherein the controller is configured to independently control the actuation mechanism.

4. The steerable sub of claim 1, wherein the actuation mechanism includes an engine.

5. The steerable sub of claim 1, wherein the steering element is a steering wheel.

6. The steerable sub of claim 5, wherein the steering wheel is located fully outside the housing.

7. The steerable sub of claim 1, wherein the steering element is a fin.

8. The steerable sub of claim 1, further comprising:

another steering element, angularly offset from the steering element, about a longitudinal axis of the housing.

9. The steerable sub of claim 1, further comprising:

a biasing wheel; and a biasing mechanism that biases the biasing wheel away from the housing.

10. The steerable sub of claim 1, further comprising:

a detonator; and a switch configured to actuate the detonator.

11. The steerable sub of claim 1, further comprising:

a controller; and a sensor that includes at least one of an accelerometer, inclinometer, magnetometer, or a gravity sensor, wherein the controller is configured to calculate an orientation of the steerable sub based on a reading from the sensor.

12. The steerable sub of claim 11, wherein the controller is further configured to calculate an orientation of gravity.

13. The steerable sub of claim 12, wherein the controller is further configured to calculate in which one of the two opposite directions to turn the steering element to align a firing direction of a shaped charge with a desired firing direction of the shaped charge, based on the calculated orientation of the steerable sub and the orientation of the gravity.

14. The steerable sub of claim 13, wherein the controller is configured to operate autonomously for aligning the firing direction with the desired firing direction.

15. The steerable sub of claim 13, wherein the controller is configured to continuously align the firing direction with the desired firing direction.

16. The steerable sub of claim 13, wherein the controller is configured to align the firing direction with the desired firing direction at selected times.

17. A gun string for perforating a casing in a well, the gun string comprising:

a gun that includes one or more shaped charges, the one or more shaped charges having a firing direction D; and a steerable sub connected to the gun, wherein the steerable sub comprises:

a housing extending along a longitudinal axis;

a steering element attached to the housing and extending into a plane, the steering element being configured (i) to partially extend out of the housing and to move along the longitudinal axis while contacting the well, and (ii) to turn in either one of two opposite directions, which are perpendicular to the longitudinal axis, which results in tilting the plane of the steering element to make a non-zero angle with the longitudinal axis; and an actuation mechanism connected to the steering element and configured to change the tilt of the steering element relative to the longitudinal axis by turning the steering element while in contact with the well.

18. The gun string of claim 17, wherein the gun is fixedly attached to the steerable sub.

19. The gun string of claim 17, wherein the steerable sub is directly attached to a wellbore tool.

20. The gun string of claim 17, further comprising:

a rotatable arm connecting the steerable sub to a wellbore tool, wherein the rotatable arm is configured to freely rotate around a longitudinal axis of the casing.

* * * * *